US007775399B2

(12) United States Patent
Wood

(10) Patent No.: US 7,775,399 B2
(45) Date of Patent: Aug. 17, 2010

(54) DISPENSING APPARATUS

(75) Inventor: Bruce Wood, Glasgow (GB)

(73) Assignee: Artex-Rawlplug Limited (GB)

( * ) Notice: Subject to any disclaimer, the term of this patent is extended or adjusted under 35 U.S.C. 154(b) by 1173 days.

(21) Appl. No.: 10/547,039

(22) PCT Filed: Feb. 26, 2004

(86) PCT No.: PCT/GB2004/000850

§ 371 (c)(1),
(2), (4) Date: Mar. 7, 2006

(87) PCT Pub. No.: WO2004/076078

PCT Pub. Date: Sep. 10, 2004

(65) Prior Publication Data

US 2006/0175348 A1 Aug. 10, 2006

(30) Foreign Application Priority Data

Feb. 26, 2003 (GB) ..... 0304351.0

(51) Int. Cl.
*B65D 35/22* (2006.01)

(52) U.S. Cl. ..... 222/94; 222/95; 222/105; 222/136; 222/145.6; 222/327; 222/386; 222/541.3

(58) Field of Classification Search ..... 222/94, 222/95, 137, 105, 107, 145.5, 145.6, 326, 222/327, 386, 1, 541.3; 206/219; 229/56
See application file for complete search history.

(56) References Cited

U.S. PATENT DOCUMENTS

| | | | | |
|---|---|---|---|---|
| 3,323,682 | A * | 6/1967 | Creighton, Jr. et al. | 222/94 |
| 3,861,522 | A * | 1/1975 | Llewellyn et al. | 206/219 |
| 4,227,612 | A * | 10/1980 | Dillon | 206/219 |
| 4,735,509 | A * | 4/1988 | Rausch | 366/333 |
| 4,981,241 | A | 1/1991 | Keller | 222/137 |
| 5,033,650 | A * | 7/1991 | Colin et al. | 222/137 |
| 5,184,757 | A * | 2/1993 | Giannuzzi | 222/82 |
| 5,282,812 | A * | 2/1994 | Suarez, Jr. | 606/158 |
| 5,304,396 | A * | 4/1994 | Lund | 427/230 |
| 5,332,122 | A * | 7/1994 | Herold et al. | 222/105 |
| 5,443,181 | A * | 8/1995 | Popp et al. | 222/95 |
| 6,048,201 | A * | 4/2000 | Zwingenberger | 433/90 |
| 6,302,574 | B1 * | 10/2001 | Chan | 366/160.4 |

FOREIGN PATENT DOCUMENTS

| | | | |
|---|---|---|---|
| DE | 29606463 | U1 | 9/1997 |
| EP | 441538 | A2 * | 8/1991 |
| EP | 0747114 | A1 | 12/1996 |
| GB | 2019952 | A | 11/1979 |

* cited by examiner

*Primary Examiner*—Frederick C. Nicolas
(74) *Attorney, Agent, or Firm*—Gifford, Krass, Sprinkle, Anderson & Citkowski, P.C.

(57) ABSTRACT

The present invention relates to an apparatus (100) for the storing and dispensing of products. In particular, the present invention relates to an apparatus (100) for the storing and dispensing of inter-reactive compounds wherein the inter-reactive compounds are efficiently mixed on extrusion or expulsion.

14 Claims, 12 Drawing Sheets

DISPENSING APPARATUS

FIELD OF THE INVENTION

The present invention relates to apparatus for the storing and dispensing of products. In particular, the present invention relates to apparatus for the storing and dispensing of inter-reactive compounds wherein the inter-reactive compounds are efficiently mixed on extrusion or expulsion.

BACKGROUND OF THE INVENTION

Dispensing apparatus in the form of cartridges is well-known in the art. In many instances, it is necessary to mix at least two different compounds together. On mixing, the compounds may react and usually harden. This type of technology is commonly used in chemical anchors, adhesives, sealants, food processing and medical applications.

Previous dispensing apparatus which requires the mixing of different compounds usually comprises two or more separate moulded compartments i.e. cartridges. These moulded compartments each house respective compounds which are mixed on extrusion or expulsion through an orifice. Additionally previous types of dispensing apparatus have various limitations such as significant 'tooling-up' costs in machinery for making the separate moulded cartridges. The moulded cartridges are also usually supplied in predetermined sizes meaning that different dispensing apparatus and pressure guns are required for each different size of cartridge. Moreover, in these types of apparatus, usually at least two pistons are required to obtain the correct mix of different compounds, again further adding to the complexity and cost of such a device.

EP 0754633 relates to cartridge systems used in dispensing devices suitable for dispensing inter-reactive multi-component compositions. The system disclosed in EP 0754633 comprises a clip which is manually pulled out of a container so that a flexible cartridge containing two separated types of material extends beyond the nozzle of the dispensing device. The protruding end of the cartridge is then cut with a knife or a pair of scissors. On extruding said material, the different components are intended to be mixed. However, a number of problems exist with such a system. First of all, the clip is very difficult to pull out meaning that a pair of pliers is almost essential to pull the clip out. Furthermore, the use of a knife or scissors is dangerous to a user as a significant amount of pressure is required to cut the cartridge open. Moreover, on cutting the cartridge open, some of the material spills out which necessitates cleaning of the scissors/knife and/or cartridge end.

It is an object of at least one aspect of the present invention to obviate or mitigate at least one or more of the aforementioned problems.

It is a further object of at least one aspect of the present invention to provide dispensing apparatus which is easy to use.

It is a yet further object of at least one aspect of the present invention to provide a container for products which can then be used to dispense the product in a simple and effective manner.

A further object of at least one aspect of the present invention is to provide a container for a multi-part chemical product which allows the component parts to be kept separate for storage purposes, but then allows the component parts to be brought together when required for use.

It is a yet further object of at least one aspect of the present invention to provide apparatus for storing products which can also be used for accurate dispensing of the products when required.

SUMMARY OF THE INVENTION

According to a first aspect of the present invention there is provided apparatus for storing and dispensing a product, the apparatus comprising:

a cartridge; and a substantially rigid outer casing;

wherein the substantially rigid outer casing is adapted to receive the cartridge and the cartridge comprises a weakened area capable of rupturing when pressure is applied to the cartridge.

On rupturing of the weakened area, the total content(s) of the cartridge is (are) dispensed.

The cartridge may be 'sausage-like' in shape and may be formed in any suitable extrusion apparatus such as an adapted edible sausage making apparatus.

The cartridge may be made from thin, flexible film with a high tear strength. The cartridge may be made from any suitable plastics material such as polyethylene. Alternatively, the cartridge may be made from a metal/alloy foil.

Typically, the material forming the cartridge is not too elastic. If the material is too elastic, the apparatus will not function properly.

The material forming the cartridge may also be chosen so that it does not react and/or deteriorate on contact with the contained compounds.

Typically, the cartridge may comprise a plurality of separate chambers and, in particular, at least two chambers. The different chambers may contain different compounds which are intended to be mixed. The chambers may be of different volumes and may therefore contain different amounts of the different compounds. For example, the volume in a first chamber may be 40% of the whole cartridge and the second chamber may be 60% of the whole cartridge; the volume in the first chamber may be 20% of the whole cartridge and the volume in the second chamber may be 80% of the whole cartridge; and the volume in the first chamber may be 10% of the whole cartridge and the volume in the second chamber may be 90% of the whole cartridge.

Conveniently, on initial formation, the cartridge may have two open ends. Once the compound or compounds are extruded into the chamber or separate chambers of the cartridge, the ends of the cartridge may be sealed with any suitable sealing means. The seal for the end of the cartridge which is intended to rupture may be made weaker than a seal at the other end of the cartridge. The sealing means may comprise a sealing clip which may be releasable under pressure. Alternatively, any other suitable sealing means such as crimping, gluing, heat sealing or any form of cap or tie may also be used.

Preferably, on release of the sealing means different contents of the cartridge may mix substantially simultaneously together. This occurs as the single sealing means, seals all the contents of the cartridge. The mixing may occur immediately meaning that an efficient mix may be obtained.

Preferably, the substantially rigid outer casing may be a hollow cylindrical member made from any suitable plastics, metal or alloy material. The outer casing may have an inner cylindrical section which may be of constant diameter from one end to the other. Alternatively, the cylindrical member at one end may have a reduced diameter.

Typically, the outer casing is adapted to receive the cartridge and form a snug fit with the outer walls of the cartridge. The distance between the outer casing and the cartridge may be about 1-10 mm or preferably about 5 mm. This may prevent radial expansion (i.e. widening) on application of pressure to an end of the cartridge.

Conveniently, pressure may be applied to one end of the flexible cartridge by any suitable means such as any type of dispensing gun. The pressure may be applied manually or via a pneumatic piston. Typically, the dispensing gun may be a standard mastic gun as found in many DIY stores. Alternatively, any type of syringe like plunger or screw like plunger may be used.

Conveniently, there may be an expansion chamber into which the cartridge may partially expand into. The apparatus may be adapted so that on application of pressure to one end of the cartridge, expansion in the axial direction is prevented so that at the opposite end to which the pressure is applied, the cartridge deforms into an initial bulbous conformation.

Preferably, the outer casing comprises integral reaction shoulders which abut and prevent the cartridge from moving further along the longitudinal length of the outer casing as pressure is applied. The reaction shoulders may be adapted to the shape of the cartridge and may be substantially concave. The actual surface contact area between the reaction shoulder and the cartridge may be specifically chosen. If there is too much surface contact between the reaction shoulder and the cartridge, too much pressure will need to be applied to remove the sealing means from the cartridge and the material forming the cartridge may rupture at any specific point meaning that different compounds in different chambers may not mix. Alternatively, if there is too little surface contact between the reaction shoulders and the cartridge, the cartridge will be pushed through the outer casing without the sealing means rupturing.

In an alternative embodiment, the reaction shoulder may be formed from a separate insert which may be inserted into the outer casing. In a yet further alternative, the cartridge may be glued to the side of the outer casing thereby preventing movement along the length of the outer casing.

Typically, the expansion chamber may be integrally formed in the outer casing during initial moulding. Alternatively, the expansion chamber may be formed by a separate adaptor unit which may be placed into the outer casing. In a further alternative, the expansion chamber may be contained within a separate nozzle member.

Conveniently, the apparatus comprises a nozzle member which may be fitted to an end of the outer casing via, for example, a screw thread. The nozzle may comprise an integral mixer unit which further aids the mixing of the different products in the flexible cartridge. Alternatively, the mixer unit may be a separate item and may be inserted into the nozzle. Preferably, the diameter of the nozzle is wide enough to prevent blockage on release of the sealing means.

The nozzle may also comprise means for catching the sealing means such as a cross-member. The cross-member may be attached to the mixer unit or may be integrally formed at the entrance to the nozzle.

Preferably, the sealing means may be formed from any metal or plastics material such as soft aluminium or steel wire which is wound round the ends of the cartridge. The sealing means is not attached too tightly or too strongly as this will prevent the release of the sealing means on application of pressure to the cartridge. It is also preferred that any sharp ends formed by the sealing means may be pointed away from the flexible cartridge thereby preventing any possible piercing of the cartridge.

An advantage of the apparatus is that once the contents of the cartridge are emptied, the emptied cartridge may be removed and replaced with a new cartridge. The apparatus may therefore be reusable. The emptied cartridge may be removed by simply detaching the pressure gun from the cartridge. To facilitate the removal of the emptied cartridge, the outer casing may have a hinged opening to allow a user easy entry.

Preferably, the film forming the cartridge is adapted so that on expansion into the expansion chamber, the film extends part way into the expansion chamber. This may prevent mixing of different compounds and may therefore prevent any hardening of mixed materials within the apparatus. This may allow the apparatus to be used at a later date without completely emptying the contents of the cartridge.

Typically, the apparatus may be used to provide dispensed products for use in chemical anchors, sealants, food processing and medical applications. Uses of chemical anchors includes securing bolts in concrete/masonry, forming a stud socket and post-installed rebar connections.

Compounds which are intended to be mixed may include any suitable resins, epoxies, polyesters and vinyl esters.

According to a second aspect of the present invention, there is a provided a method for dispensing a product, the method comprising:

inserting a cartridge which comprises a weakened area into a substantially rigid outer casing which is adapted to receive the cartridge; and applying pressure to the cartridge thereby increasing the pressure within the cartridge to a point where said weakened area ruptures enabling the contents of the cartridge to be dispensed.

Typically, the cartridge comprises a plurality of chambers containing different compounds.

Preferably, on rupturing of the weakened area, different compounds in the cartridge may be simultaneously mixed.

According to a third aspect of the present invention, there is provided a kit comprising:

a cartridge comprising at least one weakened area capable of rupturing on application of pressure to the cartridge;

a substantially rigid outer casing which is adapted to receive the cartridge; and a dispensing gun.

Preferably, the dispensing gun is a standard mastic gun.

Preferably, the kit may be used to simultaneously mix different compounds.

According to a fourth aspect of the present invention there is provided a cartridge which comprises at least one weakened area capable of rupturing when pressure is applied to the cartridge and wherein the cartridge comprises at least two separate chambers containing different materials which are dispensable on application of pressure.

Typically, on rupturing of the weakened area the materials in the separate chambers may simultaneously mix with one another.

Conveniently, the cartridge is made from thin, flexible film with a high tear strength.

Typically, the cartridge is 'sausage-like' in shape.

According to a fifth aspect of the present invention, there is provided use of a kit according to the fourth aspect for dispensing a product.

According to a sixth aspect of the present invention, there is provided apparatus for storing and distributing a product, comprising a container which has at least one weakened area that will rupture when pressure is applied to the container.

BRIEF DESCRIPTION OF THE DRAWINGS

Embodiments of the present invention will now be described, by way of example only, with reference to the accompanying drawings in which.

DETAILED DESCRIPTION

Figure 1A:
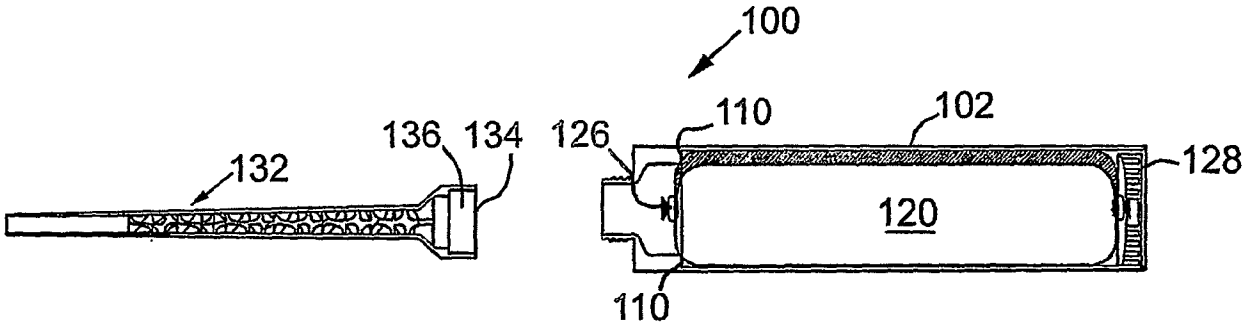
FIGS. 1A, 1B and 1C are schematic representations of dispensing apparatus according to a first embodiment of the present invention.
Figure 1B:
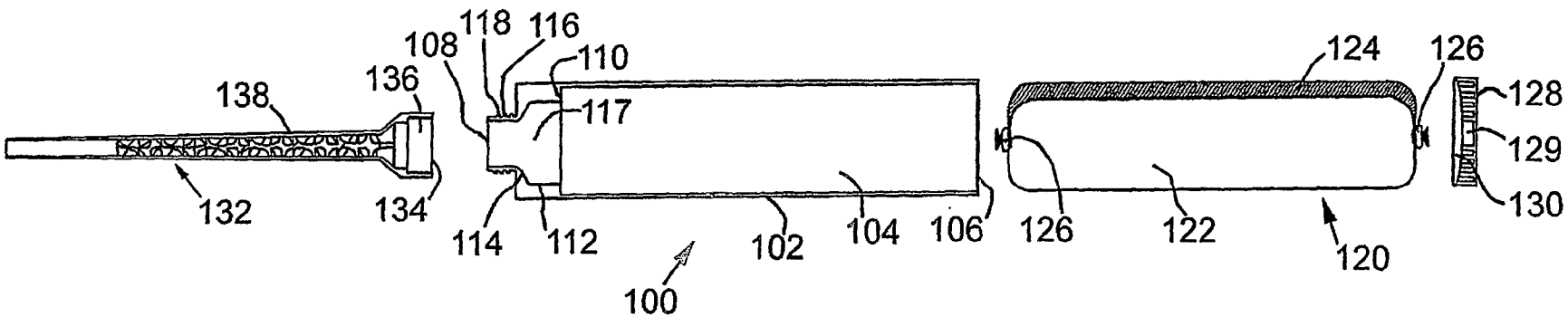

Referring to FIGS. 1A and 1B, there are schematic representations of dispensing apparatus, generally designated 100. The apparatus 100 comprises a substantially rigid cylindrical hollow casing 102. The inner surface 104 of the casing 102 has a substantially tubular section which forms a wide opening 106 at a first end of the casing 102 and a narrower opening 108 at a second end of the casing 102. Towards the second end of the casing 102, the diameter of the inner surface 104 of the casing 102 narrows, firstly via a shoulder 110, which then extends for a period along a reduced diameter section 112. There is then a further reduction in the diameter via a chamfered surface 114 to a final reduced diameter tubular section 116. The region of the casing 102 extending between the shoulder 110 and the narrow opening may be termed an expansion chamber 117. It is appreciated that the expansion chamber is proximate to and in communication with the narrow opening. On the outer surface of tubular section 116 there is a screw thread 118. The cylindrical casing 102 is made from any suitable plastics or metal/alloy material.

As shown in FIG. 1A, the cylindrical casing 102 is used to snugly receive a cartridge 120 which may be described as being 'sausage-like' in shape. The cartridge 120 comprises two separate chambers 122, 124 which are secured to one another via adhesive means in the 'sausage-like' configuration. Chamber 122 contains compound A and chamber 124 contains compound B. The chambers 122, 124 are sealed separate units.

The chambers 122, 124 are formed from a thin material which has a limited degree of flexibility. However, the material is not too elastic otherwise the material will simply stretch on application of pressure. The material also has a high tear strength to prevent the cartridge 120 from inadvertently bursting open. The material is also specifically chosen so as to be inert towards the materials which they contain. The material may be made from any suitable plastics, polymer or metal foil material.

The ends of the cartridge 120 are closed with clips 126 once compounds A and B have been inserted into their respective chambers 122, 124. Any suitable type of apparatus is used to form the 'sausage-like' cartridge 120. For example, edible sausage making apparatus may be used. Clips 126 are formed from relatively soft aluminium wire and are wound around the ends of the chambers 122, 124 to prevent any leakage of compounds A and B during storage or initial placement in the casing 102. Careful attachment of the clips 126 is required so that any sharp ends formed by the clips 126 do not pierce the cartridge at any time during use of the dispensing apparatus 100.

A compressing back plate 128 is also shown in FIGS. 1A and 1B which has a concave surface 130 adapted to engage with the cartridge 120.

The compressing back plate 128 comprises a central recess 129 which clip 126 inserts into on engagement with the back plate 128.

FIGS. 1A and 1B also show that the apparatus comprises a mixing nozzle, generally designated 132. The mixing nozzle 132 has an opening 134. Around the opening 134 there is a thread 136 which is adapted to screw onto thread 118 on the casing 102. The mixing nozzle 132 has an integral spiral chamber 138 which aids in the mixing of compounds A and B.

FIG. 1A shows that the cartridge 120 is tightly secured within the casing 102. It is important to appreciate that the sides of the cartridge 120 are close to or abut against the inside surface 104 of the casing 102, therefore restricting any form of axial displacement. Furthermore, the cartridge 120 engages against shoulder 110 and prevents the cartridge 120 from travelling any further along the casing 102.

Figure 1C:
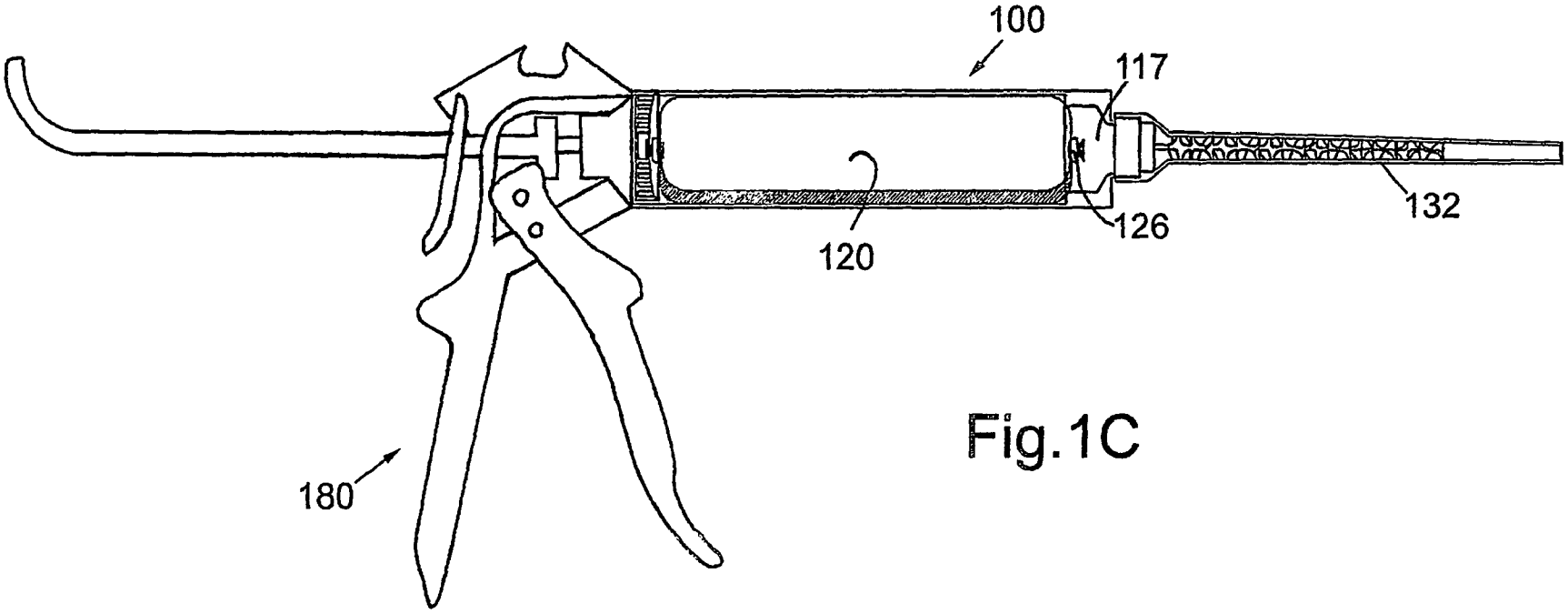

FIG. 1C shows the apparatus as illustrated in FIGS. 1A and 1B attached to a dispensing gun 180.

FIGS. 2A-2E represent a casing 202 according to a second embodiment of the present invention. Similar reference numerals to that used in FIGS. 1A and 1B are used but have the prefix "2". The container 202 is similar to the casing 102 in FIGS. 1A and 1B, apart from the fact that there is a difference in the surface 214 in the casing 102 which reduces the diameter of the inner surface 204 of the casing 102. Surface 214 reduces the diameter in a smoother concave manner, minimising any sharp edges which may pierce the cartridge 220.

Figure 2A:
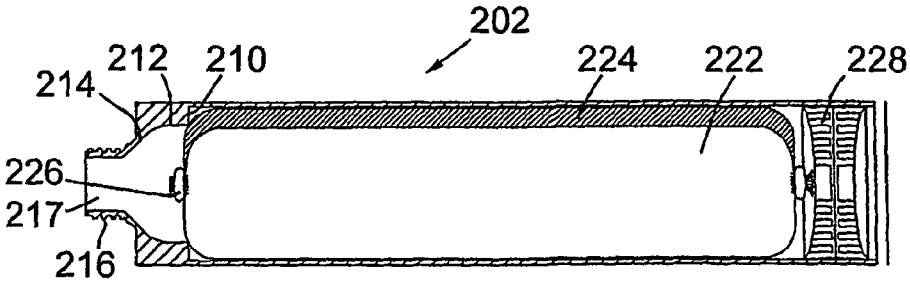
FIGS. 2A-2E are schematic representations of the operation of dispensing apparatus according to a second embodiment of the present invention.
Figure 2B:
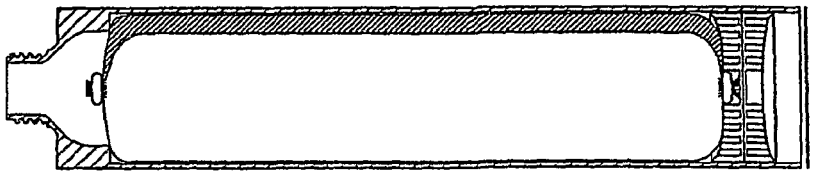
Figure 2C:
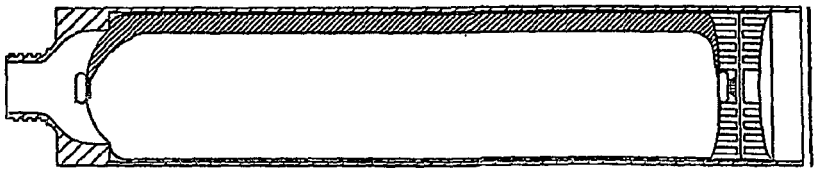
Figure 2D:
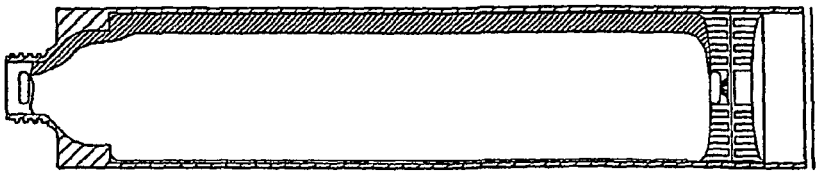

FIGS. 2A-2E progressively show the effect on the cartridge 220 as pressure is applied to one end. The pressure is applied by a mastic gun (not shown). In FIG. 2D it is clear that the cartridge 220 comprising separate chambers 222, 224 fills expansion chamber 217 at the end of the container 202 and abuts the inner surface 204 of the casing 202. It should also be appreciated that shoulders 210 prevent the cartridge 220 from merely being pushed along the container 202. The inner surface 204 of the hollow casing 202 also prevents the cartridge 220 from merely expanding axially. On application of pressure to the cartridge 220, the unsupported end of the cartridge 220 expands into a bulbous form into expansion chamber 217 as shown in FIGS. 2B and 2C and eventually completely fills the expansion chamber 217, as shown in FIG. 2D.

Figure 2E:
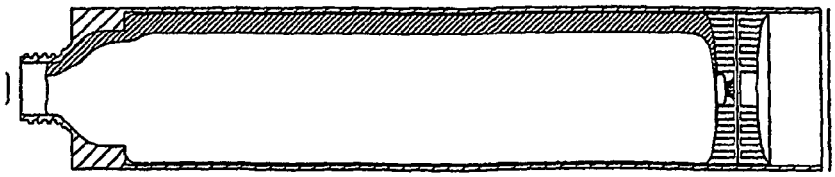

On application of further pressure, the hydrostatic pressure inside the cartridge 220 eventually forces the clip 226 off, as shown in FIG. 2E.

As shown in FIG. 2E, the film of the cartridge 220 extends part way along the narrowest section of the casing 202 which helps to prevent any hardening of material therein.

On removal of the clip 226, compounds A and B within the separate chambers 222, 224 are free to be extruded on application of further pressure from a mastic gun.

Furthermore, on release of clip 226, compounds A and B are released substantially simultaneously enabling the different compounds to efficiently mix.

Figures 3A, 3B, 3C:
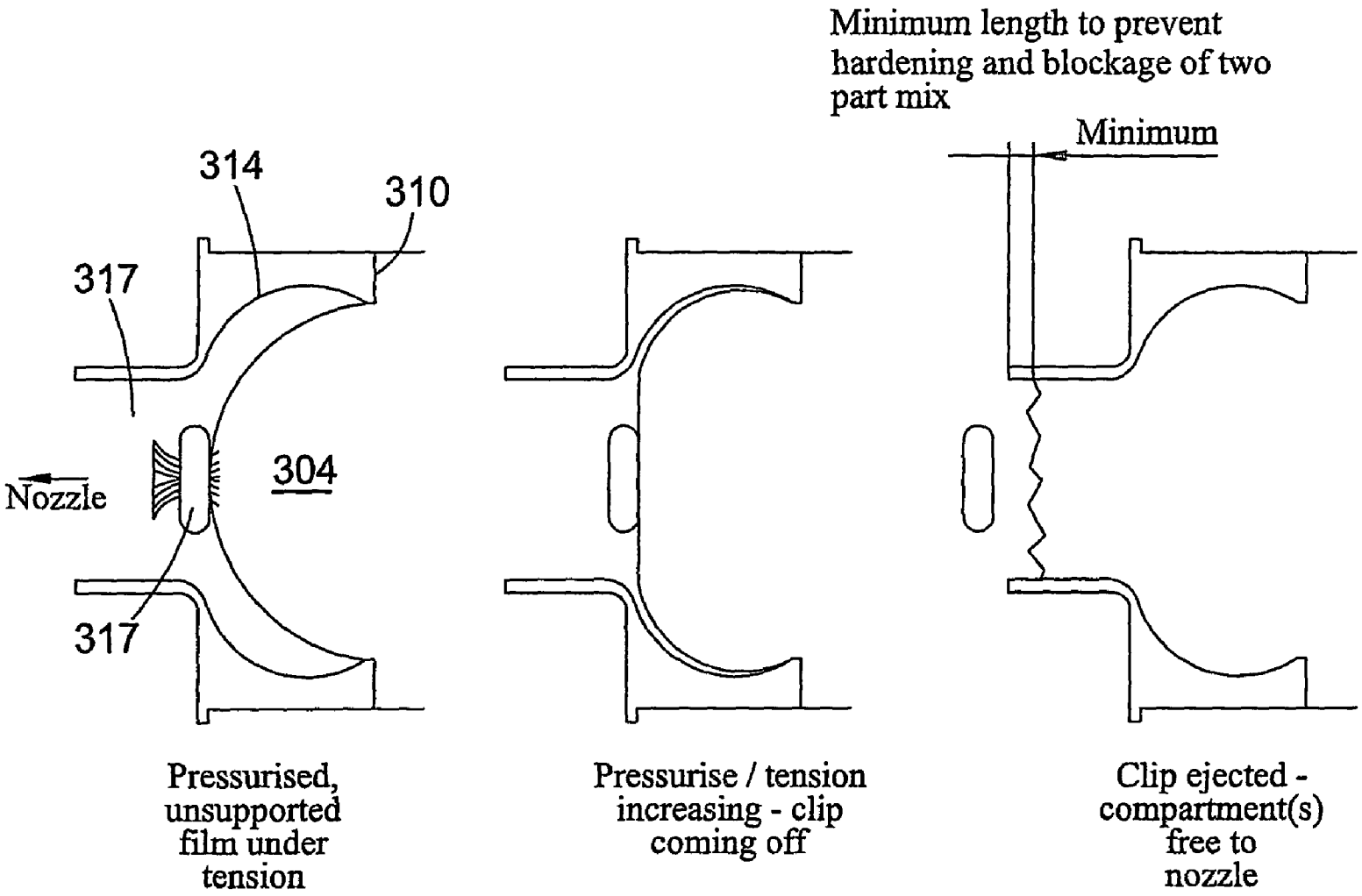
FIGS. 3A-3C are schematic representations of dispensing apparatus according to a third embodiment of the present invention.

FIGS. 3A-3C show a third embodiment of the present invention. Once again, reference signs similar to that previously used are utilised with the prefix "3". Side surfaces 314 are concave shaped to support the cartridge 320 as pressure is applied from a mastic gun. The cartridge 320 fills the expansion chamber 317 at the end of the container 302. FIG. 3C shows the clip 326 being forced off due to the increased pressure, with the minimum length between a nozzle and the film being shown which prevents hardening and blockage of compounds A and B if extrusion of the material is stopped at any time.

Figure 4A:
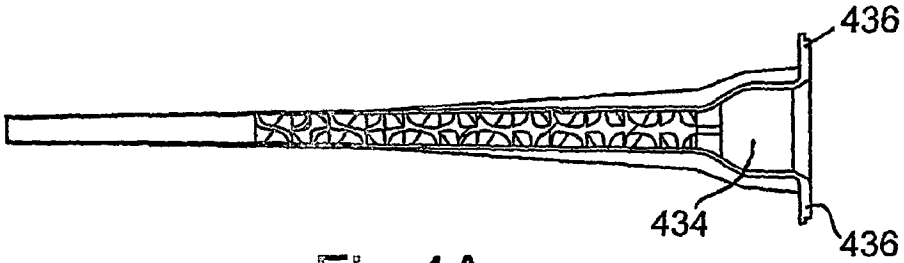
FIGS. 4A and 4B are schematic representations of dispensing apparatus according to a fourth embodiment of the present invention.
Figure 4B:
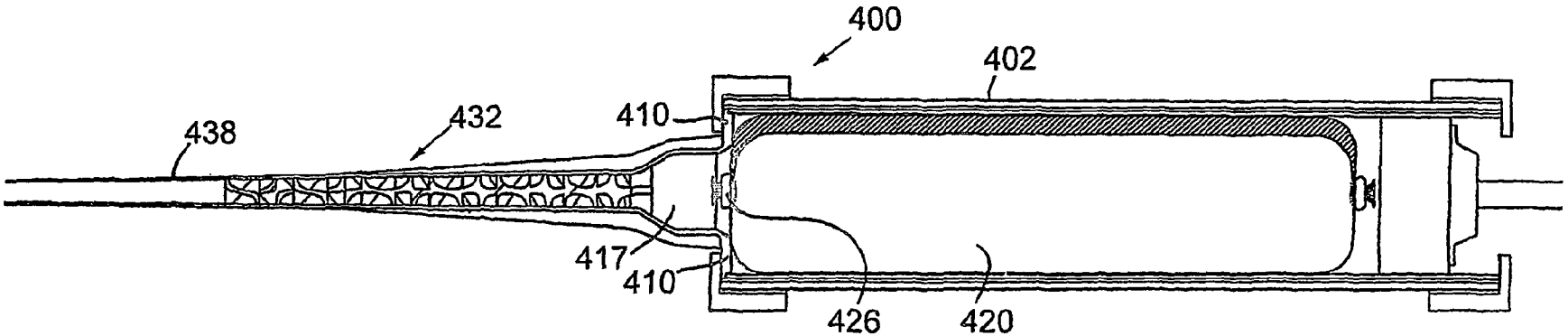

FIGS. 4A and 4B represent a fourth embodiment of the present invention. Reference signs similar to those previously used are utilised with the prefix "4". In FIG. 4B, the cartridge 420 is shown within the casing 402. In this embodiment, the casing 402 simply comprises an extended tubular section 404 of uniform diameter. There is therefore no expansion chamber in the casing 402 on insertion of the cartridge 420. However, as shown in FIGS. 4A and 4B, the mixing nozzle 432 comprises an expansion chamber 417 via which the cartridge 420 may expand into on application of pressure to the opposite end. The container 402 has shoulders 410 which prevent the cartridge 420 from being longitudinally displaced on application of pressure. Additionally, the container 402 prevents axial displacement of the cartridge 420 on application of pressure. The cartridge 420 will therefore expand into expansion chamber 417. Eventually, as discussed previously, clip 426 will release once a specific internal hydrostatic pressure is obtained for the container 420.

Figure 5A:
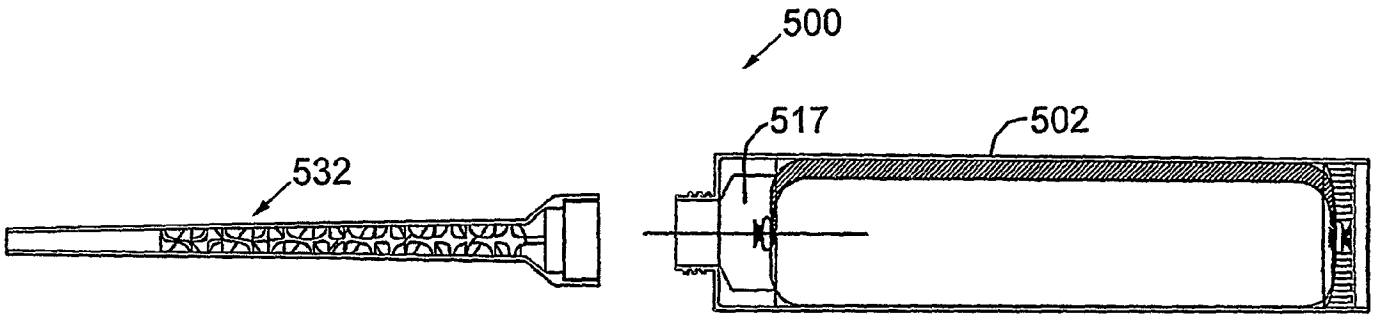
FIGS. 5A and 5B are schematic representations of dispensing apparatus according to a fifth embodiment of the present invention.
Figure 5B:
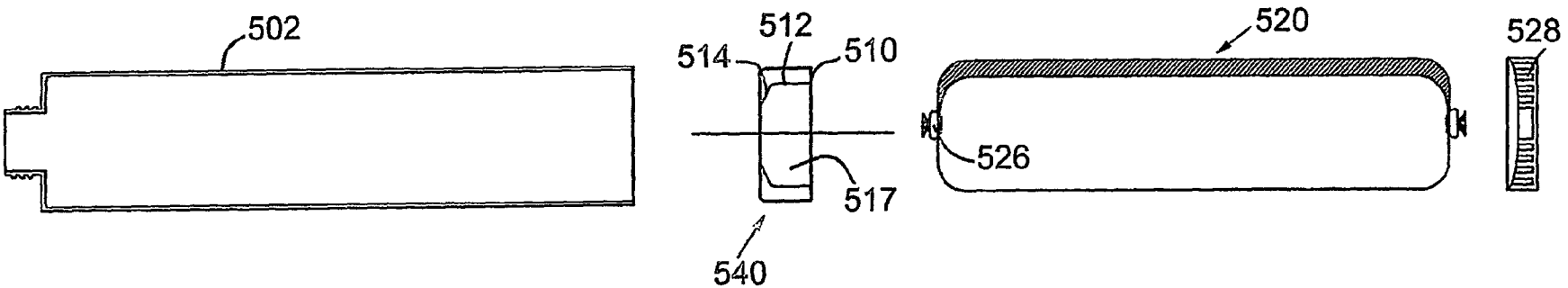

FIGS. 5A and 5B show a fifth embodiment. Similar reference signs to those used previously are used with the prefix "5". In this embodiment, a standard cylindrical hollow casing 502 is used which has a substantially uniform internal diameter. To create an expansion chamber 517 for the cartridge 520 to expand into, an adaptor 540 is inserted into the casing 502, as shown in FIG. 5A. The adaptor 540 comprises a shoulder 510 which prevents longitudinal movement of the cartridge 520. A reduced circumference section 512 and an additional surface 514 further reduces the diameter of casing 502. The operation of the cartridge 502 generally is the same as that previously described.

Figure 6A:
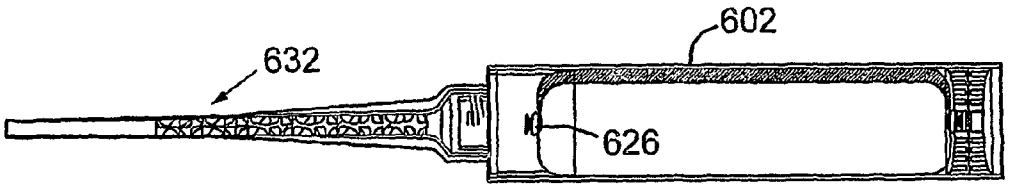
FIGS. 6A and 6B are schematic representations of dispensing apparatus according to a sixth embodiment of the present invention.
Figure 6B:
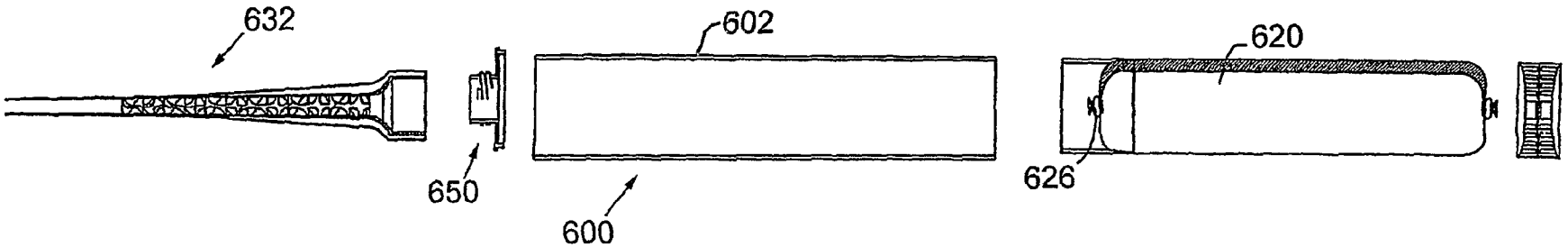

FIGS. 6A and 6B represent dispensing apparatus, generally designated 600 which is substantially similar to that described previously. The reference numerals have the prefix "6". The difference in dispensing apparatus 600 is that there is a nozzle adaptor 650 which is attachable to the container 602. This allows a range of mixing nozzles 632 to be used enabling different flows of material to be obtained.

In the present invention, there is the potential problem that the clip used to retain the different compounds in their respective chambers may block the extrusion of the compounds. To overcome this problem, means of catching the clip may be deployed.

Figure 7A:
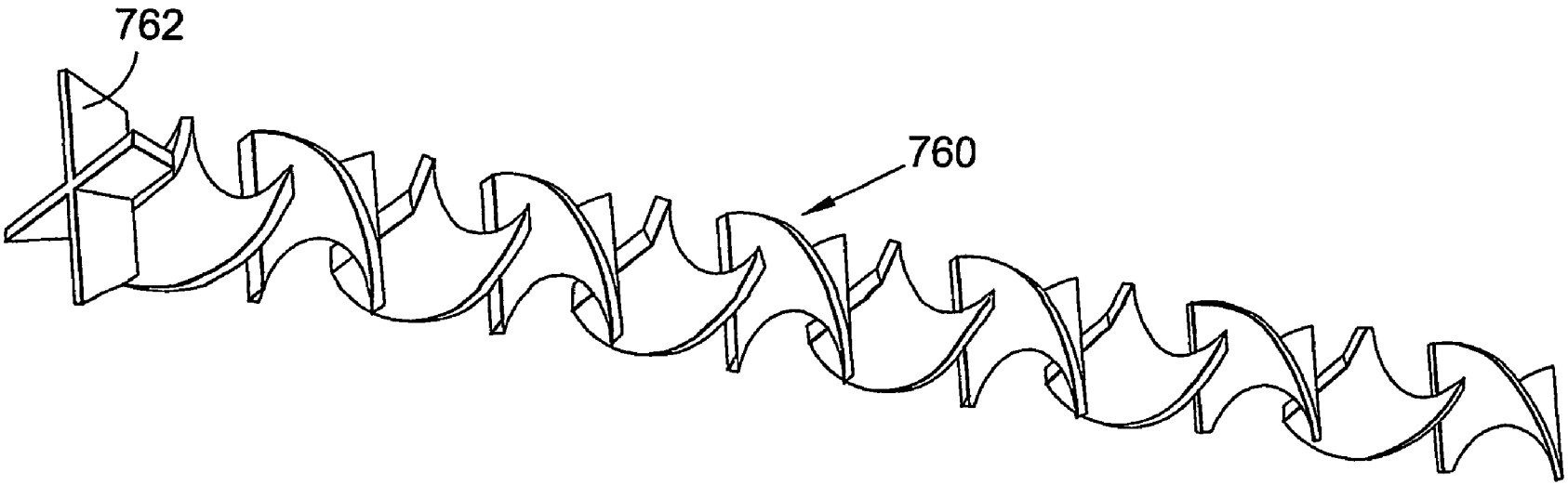
FIGS. 7A and 7B are schematic representations of a mixing element according to an embodiment of the present invention.
Figure 7B:
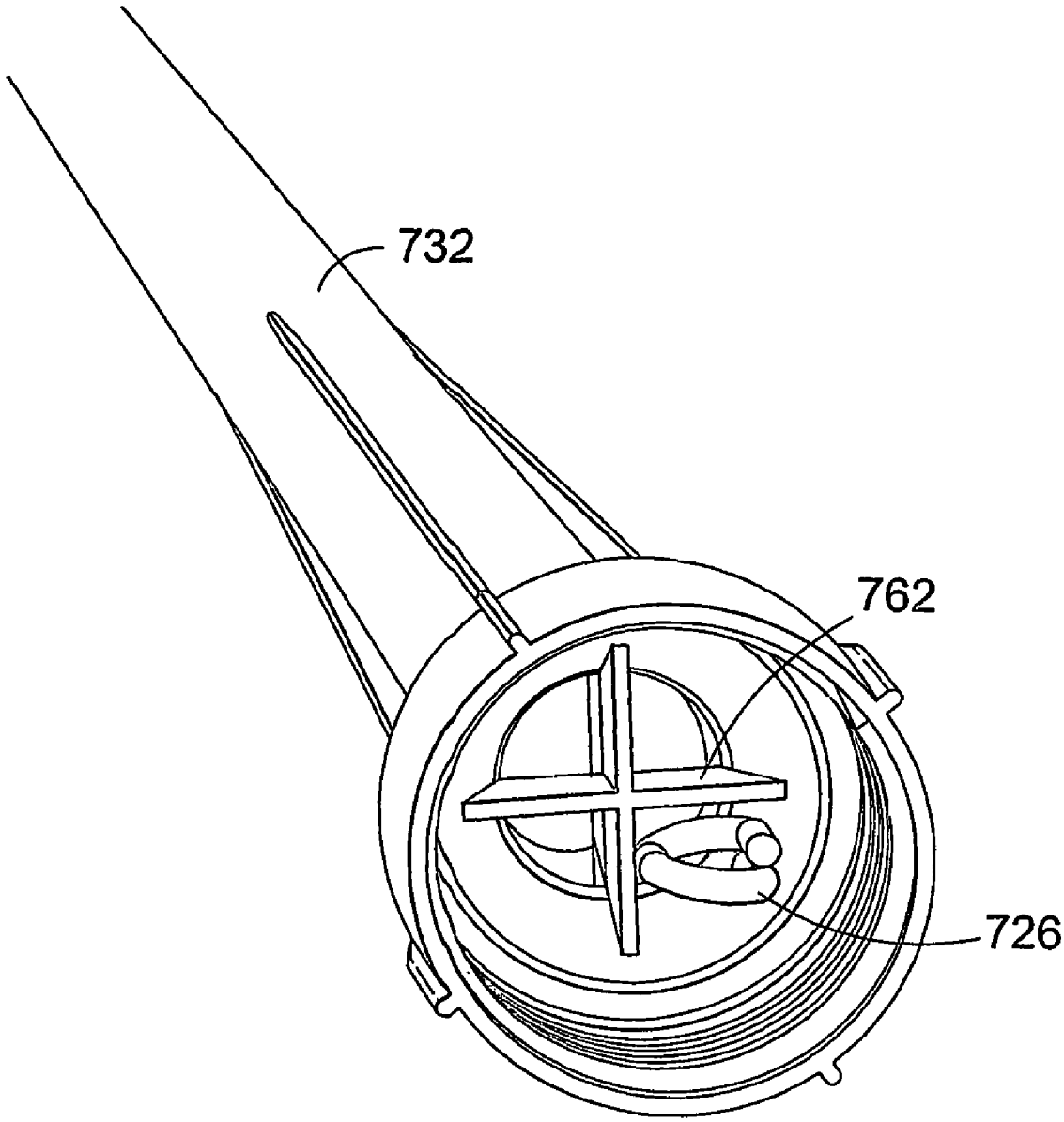

The embodiment shown in FIGS. 7A and 7B comprises a cross member 762 at one end of mixing element 760. As shown in FIG. 7B, on release of the clip 726, the cross member 762 prevents the clip 726 from entering the main body of mixing nozzle 732.

Figure 8A:
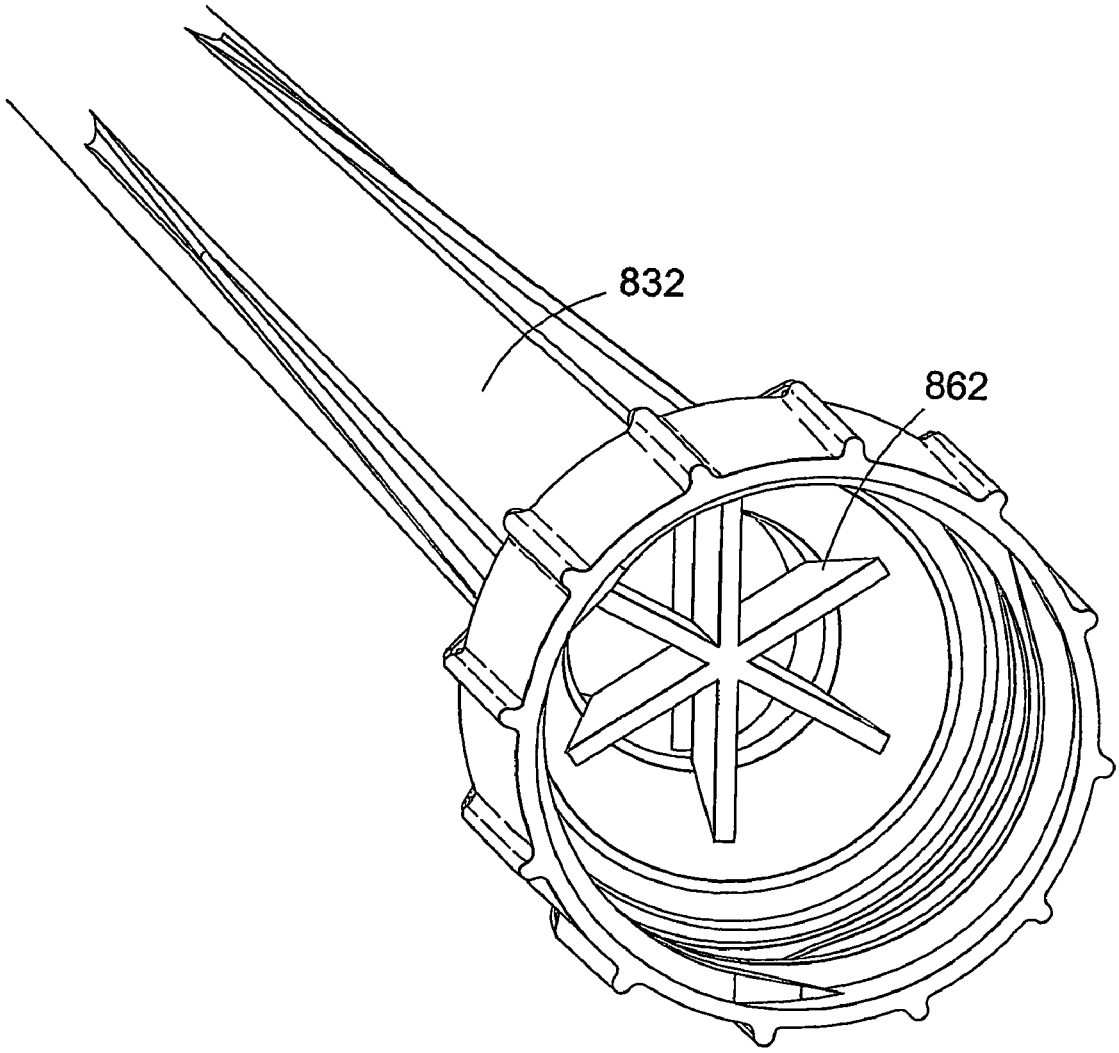
FIGS. 8A and 8B are schematic representations of a further mixing element according to an embodiment of the present invention.
Figure 8B:
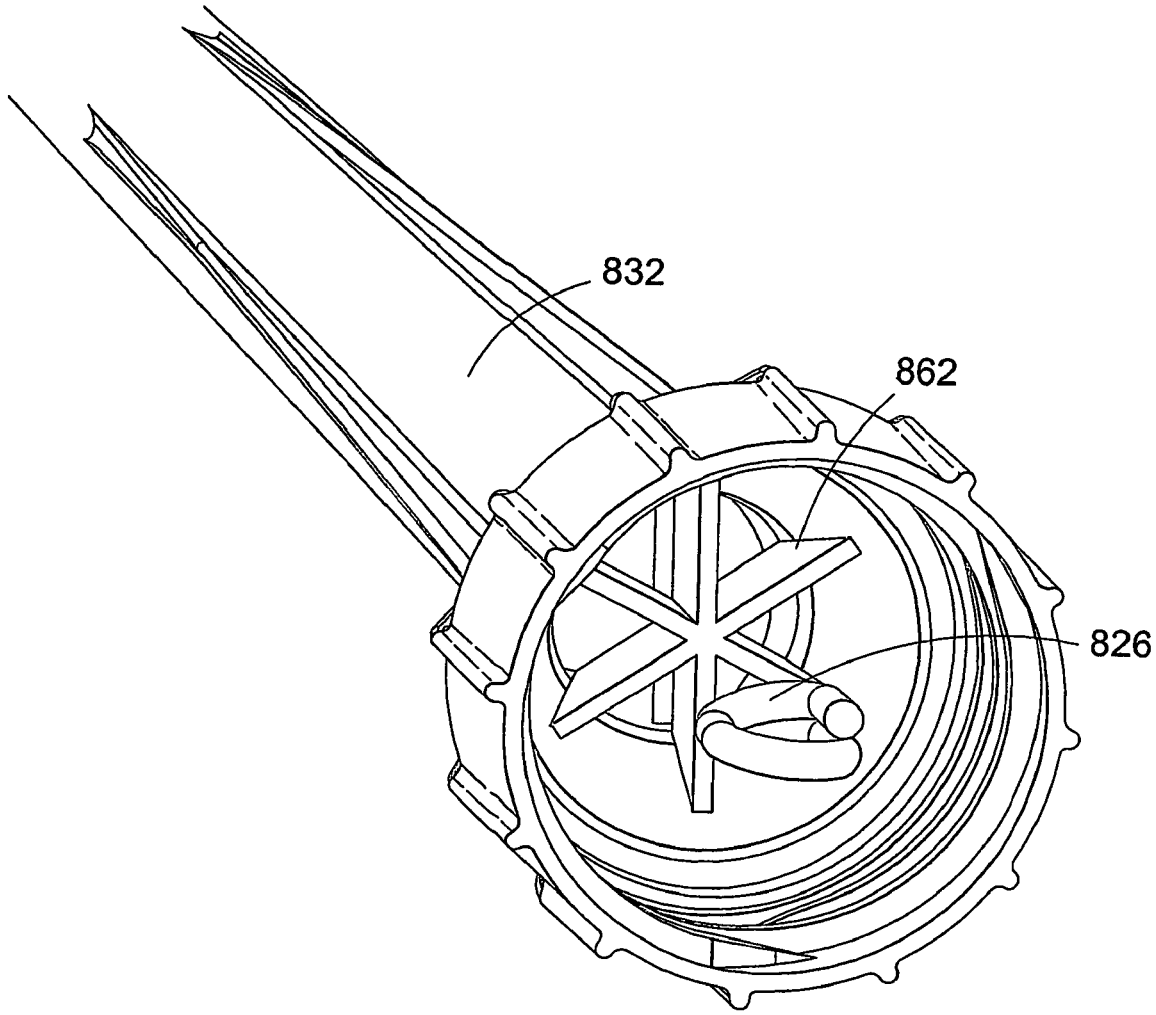

FIGS. 8A and 8B represent a further embodiment wherein mixing nozzle 832 comprises a cross-section 862 which will once again catch a clip 826 before it enters the main body of mixing nozzle 832.

While specific embodiments of the invention have been described above, it will be appreciated that departures from the described embodiments may still fall within the scope of the invention. For example, there may be any number of different chambers and the cartridges may be of any suitable size. Additionally, any type of sealing means may be used to close the ends of the chambers. Furthermore, the sealing means may be attached relatively loosely meaning that only a minimum amount of pressure needs to be applied to force the sealing means off the cartridge.

EXAMPLES

Example 1

Figure 9A:
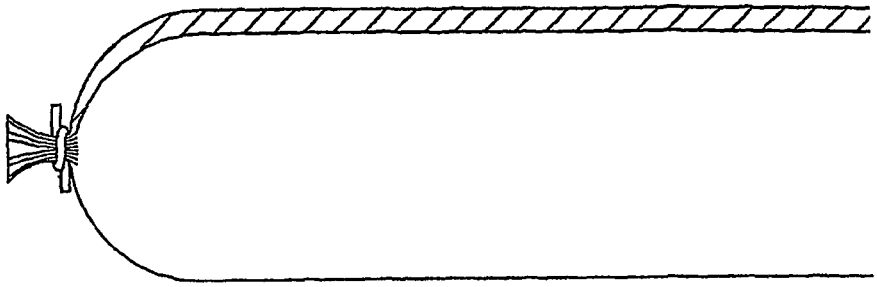
FIGS. 9A-9C are schematic representations of different casings according to the present invention.
Figure 9B:
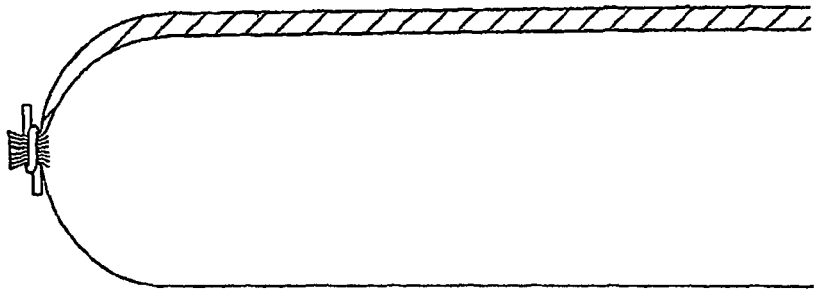
Figure 9C:
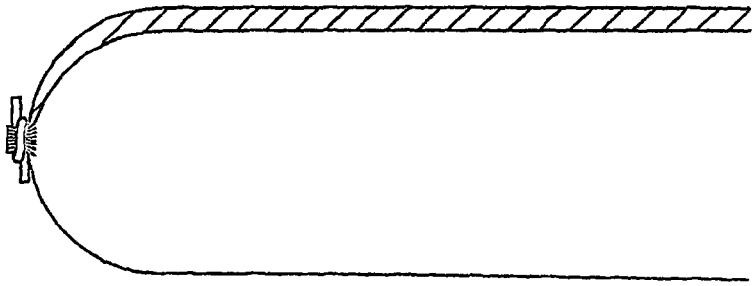

FIGS. 9A-9C represent different lengths of film extending beyond a clip. The embodiments shown in FIGS. 9A and 9B will require too high a pressure to force the clip off the casing. FIG. 9C represents more of a preferred embodiment with the film extending a relatively small distance beyond the clip.

Figure 10:
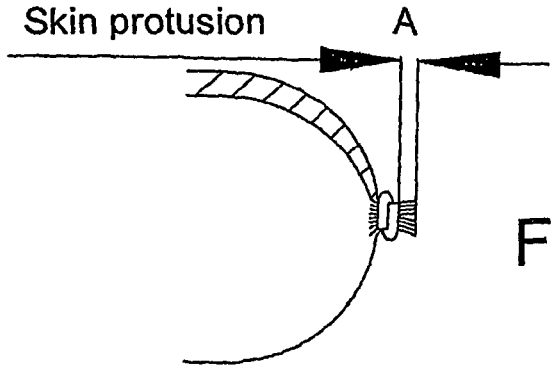
FIG. 10 is a schematic representation of the length of film extending beyond a clip.

FIG. 10 defines the distance which the film extends beyond the clip by reference symbol 'A'. Table 1 below shows that the clip only comes off when the film extends 4 mm or 2.5 mm beyond the clip.

TABLE 1

| Test | A (mm) | Burst Mode |
|---|---|---|
| 1 | 10 | Film |
| 2 | 11 | Film |
| 3 | 11 | Film |
| 4 | 10.5 | Film |
| 5 | 8 | Film |
| 6 | 7.5 | Film |
| 7 | 6 | Film |
| 8 | 5 | Film |
| 9 | 4 | Clip |
| 10 | 2.5 | Clip |

The invention claimed is:

1. Apparatus for storing and dispensing a product, the apparatus comprising:

a cartridge containing at least two separate chambers, each of the at least two separate chambers containing different compounds which are intended to be mixed; and a substantially rigid outer casing adapted to receive the cartridge, the rigid outer casing having a first end with a wide opening and a second end with a narrow opening;

a single expansion chamber proximate to and in communication with said narrow opening;

wherein products to be dispensed are sealed in the cartridge with a single rupturable sealing means in the form of a sealing clip which is releasable under pressure, the cartridge containing the at least two separate chambers expanding into the single expansion chamber and the single rupturable sealing means forming a weakened area capable of rupturing when pressure is applied to the cartridge and on release of the sealing clip different compounds of the cartridge mix substantially together.

2. Apparatus according to claim 1, wherein the cartridge is made from thin, flexible film with a high tear strength.

3. Apparatus according to claim 1, wherein the cartridge is made from a metal/alloy foil.

4. Apparatus according to claim 1, wherein the outer casing is adapted to receive the cartridge and forms a snug fit with the outer walls of the cartridge.

5. Apparatus according to claim 1, wherein pressure is applied to one end of the cartridge by a dispensing gun.

6. Apparatus according to claim 1, wherein the single expansion chamber comprises reaction shoulders which abut and prevent the cartridge from moving further along the longitudinal length of the outer casing as pressure is applied.

7. Apparatus according to claim 1, wherein the apparatus further comprises a nozzle.

8. Apparatus according to claim 7, wherein the nozzle comprises an integral mixer unit which further aids the mixing of different compounds.

9. Apparatus according to claim 7, wherein the nozzle also comprises means for catching the sealing means.

10. Apparatus according to claim 1, wherein the sealing means is formed by any metal or plastics material which is wound round the ends of the cartridge.

11. Use of apparatus according to claim 1 for dispensing products for use in chemical anchors, sealants, food processing and medical applications.

12. An apparatus according to claim 2, wherein, the single expansion chamber has a shoulder, the shoulder engaging the cartridge and preventing the cartridge from traveling any further along the casing when pressure is applied to the cartridge.

13. An apparatus according to claim 12, wherein the shoulder extends along a reduced diameter section.

14. An apparatus according to claim 1, wherein the cartridge expands fully into the single expansion chamber.

* * * * *